US007430789B2

(12) United States Patent
Wright

(10) Patent No.: US 7,430,789 B2
(45) Date of Patent: Oct. 7, 2008

(54) QUICK RELEASE STRAP FASTENER

(75) Inventor: Robert Wright, Mesquite, NV (US)

(73) Assignee: Two Rivers Manufacturing, LLC, Shelbyville, TN (US)

( * ) Notice: Subject to any disclaimer, the term of this patent is extended or adjusted under 35 U.S.C. 154(b) by 116 days.

(21) Appl. No.: 11/640,643

(22) Filed: Dec. 18, 2006

(65) Prior Publication Data

US 2008/0141504 A1 Jun. 19, 2008

(51) Int. Cl.
*A44B 11/25* (2006.01)

(52) U.S. Cl. ..... 24/615

(58) Field of Classification Search ..... None
See application file for complete search history.

(56) References Cited

U.S. PATENT DOCUMENTS 4,559,679 A 12/1985 Downey

*Primary Examiner*—Jack W. Lavinder
(74) *Attorney, Agent, or Firm*—Black Lowe & Graham, PLLC

(57) ABSTRACT

A three component strap fastener having a body member with a fork inserted into a fork end opening and a catch inserted into an opposite catch end opening in the body member is improved by reconfiguring the catch end opening so as to prevent undesirable twisting of the catch relative to the fork within the body member. Additional constrainment of the catch to prevent it from being forced out of coplanar relationship relative to the fork is achieved by narrowing the outboard extremities of the open mouth formed at the catch end opening of the body member. This added constrainment is achieved by building up the interior wall structure of the body member at the transverse outboard extremities of the catch end opening with four interior, wedge-shaped corner restraints. These corner restraints are located at the transverse, outboard extremities of the catch end opening so that the mouth of the slit at the catch end opening has truncated, pointed corners, but otherwise has a uniform, narrow dimensional thickness between its corners.

19 Claims, 6 Drawing Sheets

QUICK RELEASE STRAP FASTENER

BACKGROUND OF THE INVENTION

1. Field of the Invention

The present invention relates to a strap fastener that may be utilized to fasten the ends of flexible strap members together, such as the strap members employed to form a strap for carrying a camera, binoculars, or other article.

2. Description of the Prior Art

There are many different types of snap fasteners that may be utilized to clip and unclip the ends of a strap together. One commercially successful strap fastening system was designed for use to connect the ends of a helmet strap together for helmets used for motorcycle riding, race car driving, football, roller skating, and in other situations in which a user requires a quick disconnect system so as to be able to quickly remove and secure a helmet securely in position. This prior strap fastening system is described in prior U.S. Pat. No. 4,559,679, issued Dec. 24, 1985, which is incorporated by reference herein in its entirety.

The helmet strap fastener of U.S. Pat. No. 4,559,679 is quite suitable for fastening the ends of helmet strap members together, since the forces exerted on helmet straps are primarily limited to longitudinal tensile forces acting along the lengths of the strap members. This prior system reliably holds the helmet strap tightly closed when the strap fastener elements are engaged, and allows a quick release of the strap members when the fastener elements are disengaged.

The same strap fastening system has been successfully adapted for fastening the straps of other articles, such as cameras, binoculars, and other objects designed to be carried suspended from a strap loop.

One difficulty that has occurred with conventional strap fasteners of the type described in U.S. Pat. No. 4,559,679 is that it is possible to twist the flat strap fastening elements of the fastener system out of precise mutually coplanar alignment due to the configuration of the mouth of the body member defined at the catch end of the enclosure. That is, if a substantial torsional component of force is exerted on the strap members or on the fastener components of a conventional strap fastening system, the catch member of the fastener can become unintentionally detached from the fork member of that fastening system. When this occurs the fastener members will suddenly and unexpectedly separate. A camera, binoculars, or other valuable article suspended from the strap will then abruptly fall. Many cameras and binoculars today are quite expensive and can be severely damaged should the fastener members at the ends of the strap holding them suddenly separate.

SUMMARY OF THE INVENTION

To remedy this situation and create a strap fastener system in which the fastener elements will not become separated despite torsional, as well as longitudinal tensile forces on the strap fastener members, an improved fastener system has been devised. It has been found that the basic very functional strap fastener interengagement system described in U.S. Pat. No. 4,559,679 can be adapted for use on straps subject to torsional, as well as tensile forces by reconfiguring the entry opening in the body member of the strap fastening system. By reconfiguring the catch end opening in the body member, both the catch member and the fork member of the fastening system described in U.S. Pat. No. 4,559,679 can be stabilized to resist torsional movement relative to each other and remain in coplanar relationship in secure, tight engagement with each other until purposefully released. Thus, all of the benefits of the strap fastener system described in U.S. Pat. No. 4,559,679 can be obtained while allowing that strap fastener system to be utilized with camera straps and other straps that are subject to torsional forces.

In one broad aspect the present invention may be considered to be an improvement in a strap fastener having a body member, a fork, and a catch. The body member has transverse side openings and defines an enclosure having opposing end openings, both formed as narrow slits. These end openings include a fork end opening and an opposing catch end opening.

The fork has a loop for securement to one strap member and a pair of resilient legs for insertion into the fork end opening of the body member. Each leg of the fork defines a transversely turned out foot having a bearing ledge at the leg extremity and an outwardly projecting knee between the loop and the bearing ledge. The knees of the legs project into the transverse side openings in the body member and longitudinally immobilize the fork relative to the body member unless the feet of the fork are brought together by resilient deflection of the legs transversely toward each other.

The catch is secured to another strap member. The catch includes a plurality of hooks to transversely deflect and engage the feet of the fork when the catch is moved into the catch end opening of the body member with the fork longitudinally immobilized in the body member.

The body member includes a pair of opposing, outwardly biased, inwardly deflectable arms for forcing the knees of the fork legs toward each other to disengage the feet of the fork legs from the hooks of the catch. The body member defines a longitudinally extending, funnel-shaped entry into the enclosure at the catch end opening thereof.

In the original strap fastener system of U.S. Pat. No. 4,559,679 the catch end opening has a mouth formed as a wide, rectangular slit having a uniform opening cross section throughout the transverse width of the body member. However, according to the improvement of the invention the catch end opening is reconfigured so that it has a mouth with transverse, opposing extremities that narrow in area proceeding in outboard directions outwardly away from the fork legs.

Stated another way, the body member defines a catch entry slit at its catch end opening which is formed with a mouth having a central region of uniform thickness throughout and transverse end extremity regions that narrow in thickness proceeding in distance transversely outwardly from the fork legs.

Considered in still another way the improvement of the invention may be considered to be the construction of the catch end opening in the body member to form a longitudinally inwardly directed funnel entry within the structure of the body member with four interior corner restraints within the narrow enclosure within the body member at the outboard extremities of said catch end opening. A mouth of said catch end opening is thereby defined that has opposing outboard corners. The mouth corners narrow with increasing distance from said fork legs. The catch end opening is of uniform thickness between the corners of the mouth.

The invention may be described with greater clarity and particularity by reference to the accompanying drawings.

DESCRIPTION OF THE EMBODIMENT

Figure 1:
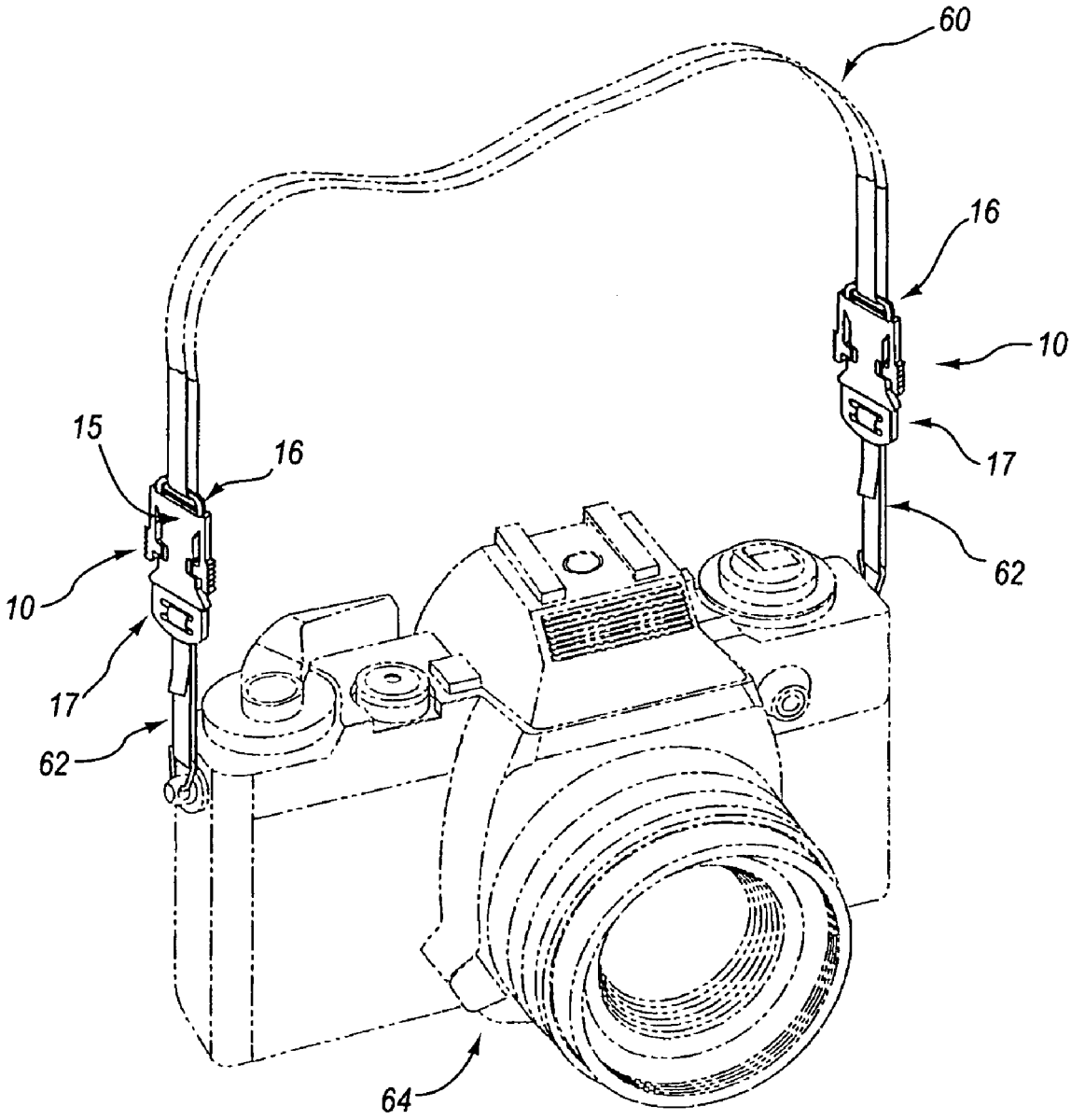
FIG. 1 is a perspective view of a camera strap employing a pair of strap fasteners constructed according to the improvement of the invention.

FIG. 1 illustrates a pair of snap fasteners 10 similar in a number of respect to the snap fasteners disclosed in U.S. Pat. No. 4,559,679, but improved according to present invention. Each snap fastener 10 is comprised of a body member 15, a fork 16, and a catch 17. Each fork 16 is secured to one of the opposing ends of an elongated neck strap 60 that forms the looped portion of a camera strap. In each of the strap fasteners 10 the catch 17 engages with the fork 16 within the structure of the body member 15. The catches 17 are secured to relatively short camera coupling strap segments 62 that are firmly attached to the opposing sides of a camera, indicated in phantom at 64. The components of a single one of the strap fasteners 10 are illustrated separated from each other in FIG. 3.

Figure 2:
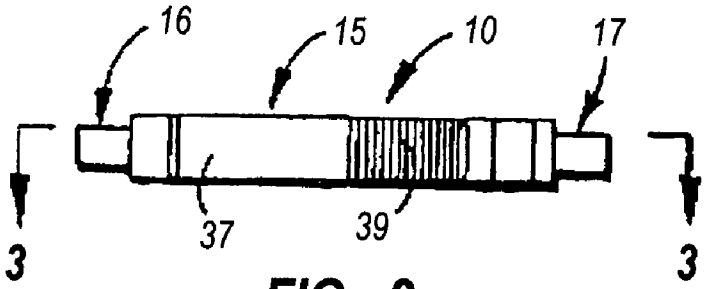
FIG. 2 is a side elevational view of a single one of the strap fasteners shown in FIG. 1.
Figure 4:
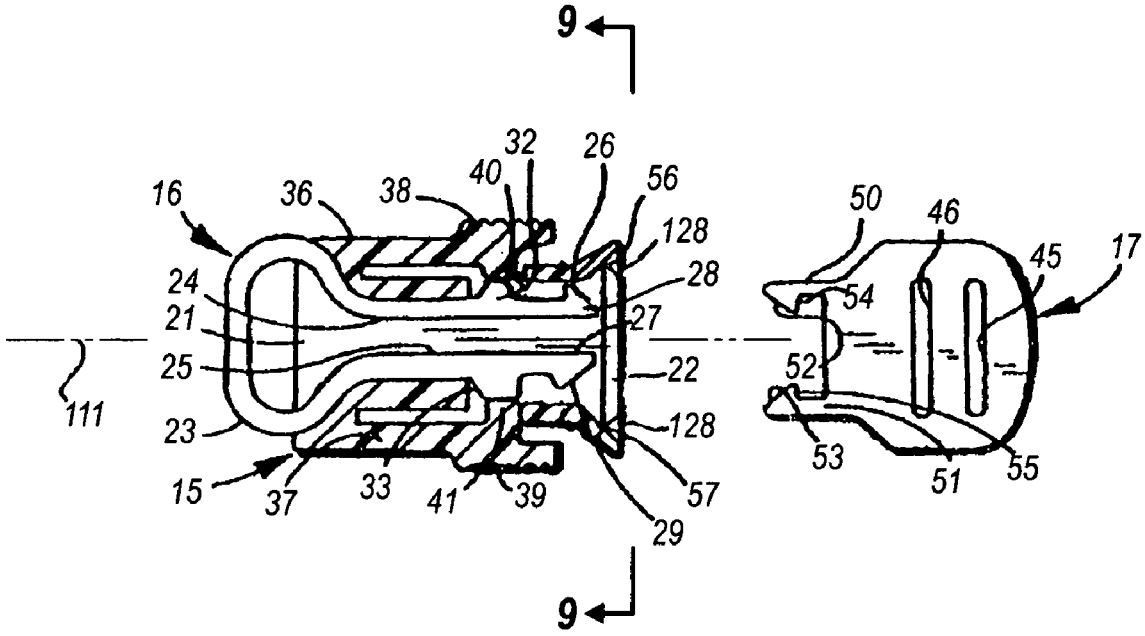
FIG. 4 is a sectional view showing the fork of the fastener system of FIG. 3 inserted into the body member.

As illustrated in FIG. 2, the body member 15 is a relatively flat structure having a longitudinal axis of symmetry 111, as shown in FIG. 4. The axis of symmetry 111 lies within a transverse plane of symmetry, indicated at 112 in FIGS. 9 and 10. The body member 15 is a unitary, injection molded plastic structure which includes a hollow shell 18 defining a flat, elongated enclosure 20 having a fork end opening 21 at one of its longitudinal ends and an opposing catch end opening 22 at its other longitudinal end. The fork end opening 21 is formed as a thin, narrow slit having a rectangular-shaped mouth. The fork end opening 21 is designed to receive the latching fork 16 therewithin. The opposite catch end opening 22 is configured to receive the latching catch 17 and has a unique structure modified from the catch opening described in prior U.S. Pat. No. 4,559,679 as will hereinafter be described.

Figure 5:
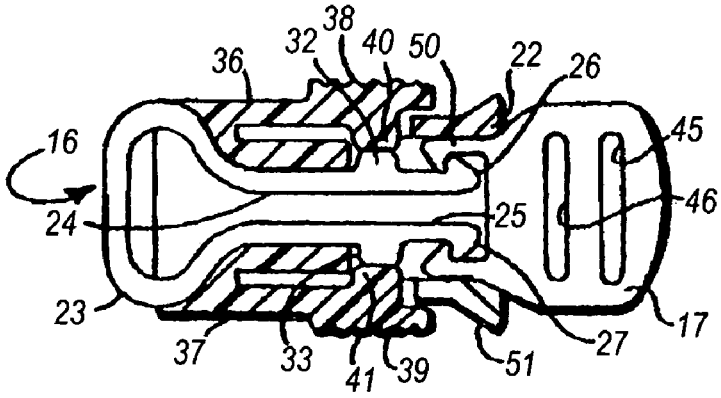
FIG. 5 is a sectional view illustrating the engagement of the catch of the fastener of FIG. 3 with the fork.
Figure 6:
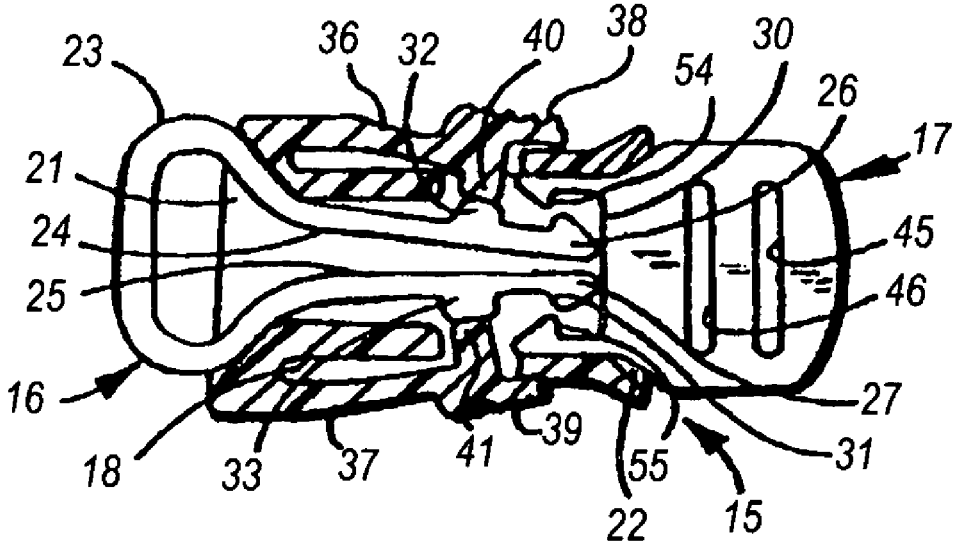
FIG. 6 is a sectional view illustrating the manner of disengagement of the catch from the fork of the fastener of FIG. 3.
Figure 7:
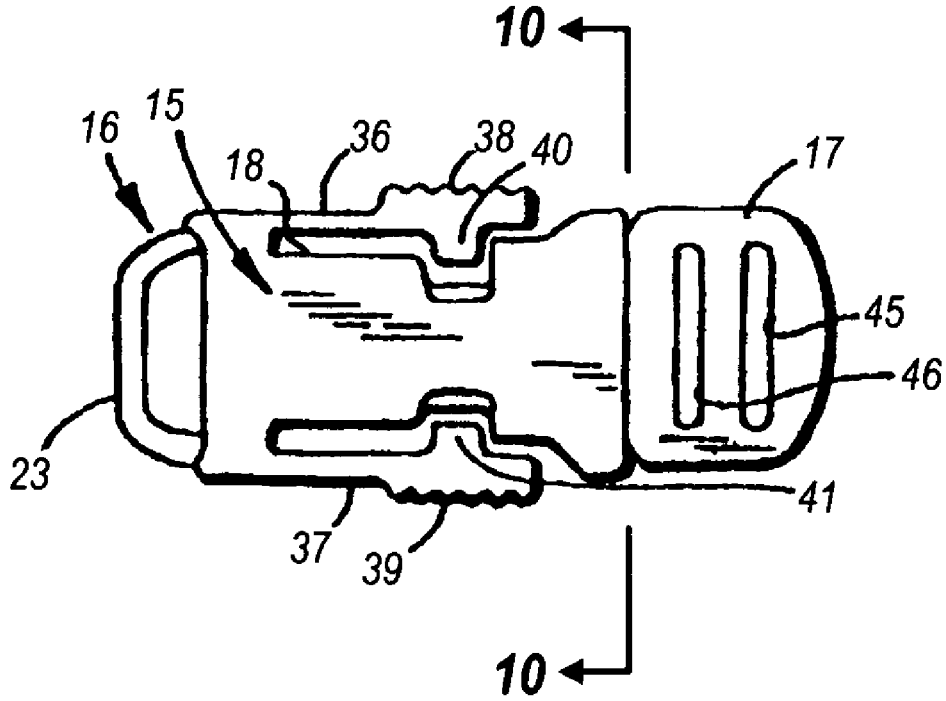
FIG. 7 is a top plan view illustrating the fastener components in the fully engaged position of FIG. 5.

The fork 16 may be stamped from a sheet of flat, stainless spring steel and is configured with a central, transversely oriented obloid loop 23 which is designed to receive a loop formed in the neck strap 60, as illustrated in FIG. 1. From the loop 23 the structure of the fork 16 extends longitudinally as a pair of generally parallel legs 24 and 25 which define feet 26 and 27 that are transversely turned out at their respective extremities. The outboard edges of the tips of the feet 26 and 27 define sloping surfaces 28 and 29 which diverge relative to the axis of symmetry of the structure of the fork 16, which coincides with the axis of symmetry 111 of the body member 15 when the fork 16 is inserted into the enclosure 20, as illustrated in FIG. 4. The turned out feet 26 and 27 also define transverse bearing ledges 30 and 31 which return from the outer extremities of the sloping surfaces 28 and 29 and which face back toward the fork end opening 21 in the body member 15 when the legs 24 of the fork 16 are inserted into the fork end opening 21, as shown in FIGS. 4-6.

The fork legs 24 and 25 are also provided with outwardly projecting knees 32 and 33, respectively, that are located between the fork loop 23 and the bearing ledges 30 and 31. The knees 32 and 33 are tab-like structures which project transversely outwardly on opposite sides of the fork 16.

The body member 15 is formed of a hollow shell 18 in which a pair of transversely directed side openings 34 and 35 are defined on the opposite sides of the shell 18. The side openings 34 and 35 are in communication with the enclosure 20 and are longitudinally aligned with each other. The body member 15 also is provided with a pair of latch tripping arms 36 and 37 which are joined at shoulders to the shell 18 adjacent the transverse outboard ends of the fork end opening 21. The latch tripping arms 36 and 37 branch from the remaining structure of the body member 15 and extend longitudinally from the outboard ends of the fork end opening 21 in the direction of the opposite end of the shell 18 at which the catch end opening 22 is formed. The latch tripping arms 36 and 37 extend to at least the transverse openings 34 and 35.

Knurled finger rests 38 and 39 are formed on the outboard edges of the latch tripping arms 36 and 37, respectively, and face transversely outwardly in opposite directions near the free extremities of the arms 36 and 37. Inwardly directed latch tripping lugs 40 and 41 are formed on the inboard edges of the structures of the latch tripping arms 36 and 37, opposite the knurled finger rests 38 and 39. The latch tripping lugs 40 and 41 project transversely toward the axis of symmetry 111 of the body member 15.

The latch tripping lugs 40 and 41 are longitudinally aligned with the side openings 34 and 35 in the shell 18. The latch tripping lugs 40 and 41 are also longitudinally aligned with the knees 32 and 33 on the legs 24 and 25 of the fork 16 when the fork 16 is fully inserted into the fork end opening 21 as depicted in FIG. 4.

The free extremities of the arms 36 and 37 are deflectable toward the shell 18 in registration with the transverse openings 34 and 35. When the knurled finger rests 38 and 39 are compressed transversely together toward the axis of symmetry 111 of the body member 15, the latch tripping lugs 40 and 41 contact the knees 32 and 33 to squeeze the legs 24 and 25 toward each other, as illustrated in FIG. 6. The knees 32 and 33 normally project into the transverse openings 34 and 35 unless the feet 26 and 27 of the legs 24 and 25 are squeezed so closely together that they contact each other.

Figure 3:
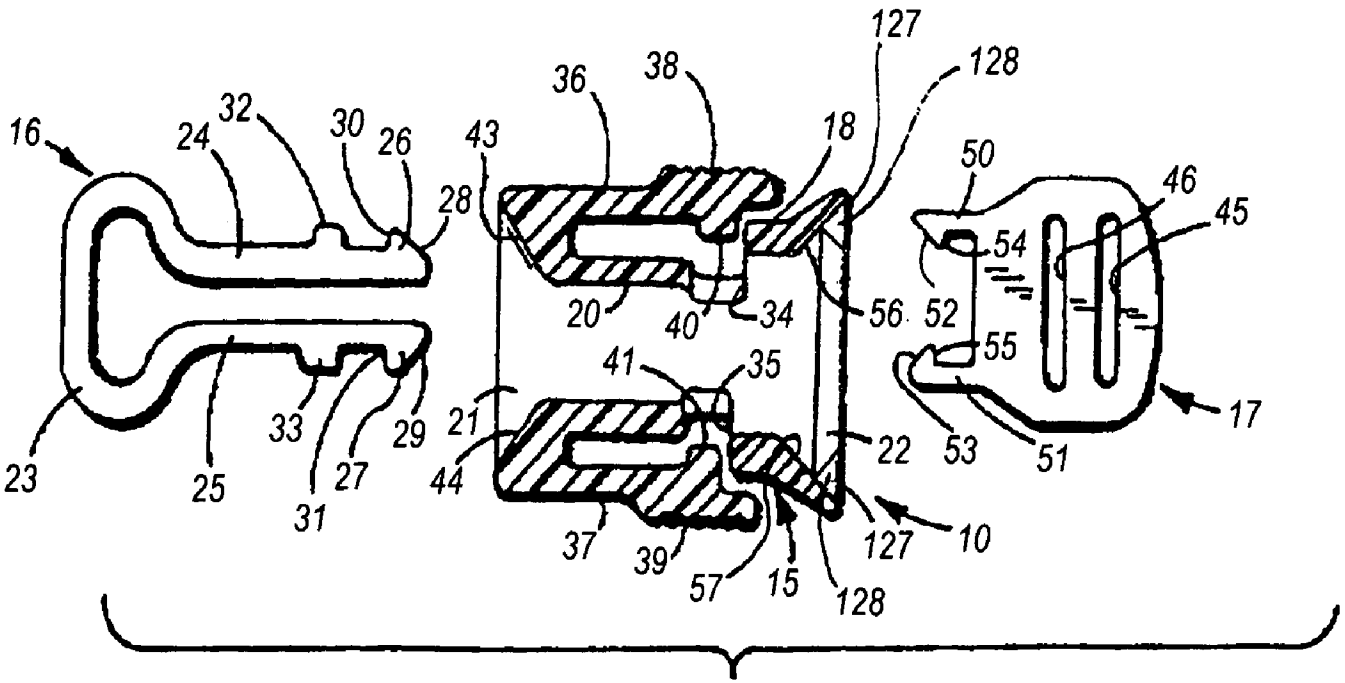
FIG. 3 is an exploded sectional view taken along the lines 3-3 of FIG. 2 illustrating the components of the strap fastener separated from each other.

When the fork legs 24 and 25 are forced so closely together that the insides of the feet 26 and 27 touch, the fork 16 can be drawn longitudinally out of the body member 15, as illustrated in FIG. 3. Withdrawal of the fork 16 from the body member 15 allows the camera strap 60 to be looped between the fork legs 24 and 25 so as to engage the central loop 23 at the middle of the fork 16 in the manner illustrated in FIG. 1. Once the camera strap 60 has been engaged with the forks 16, the forks 16 are reinserted into their respective body members 15 and remain engaged therein in the positions depicted in FIG. 4 until purposefully removed therefrom by fully depressing the finger rests 38 and 39 again.

The interior structure of the enclosure 20 is formed with transversely inwardly sloping walls 43 and 44 that angle inwardly from the fork end opening 21. The walls 43 and 44 are sloped in the same directions as the sloping surfaces 28 and 29 of the feet 26 and 27 at the ends of the legs 24 and 25 of the fork 16. The interior body member surfaces 43 and 44 thereby deflect the fork legs 24 and 25 toward each other when the fork 16 is inserted into the body member 15. As longitudinal force is exerted along the body member axis of symmetry 111 to push the fork 16 and the body member 15 together from the state of separation depicted in FIG. 3 to a position of engagement as depicted in FIG. 4, the feet 26 and 27 are squeezed into contact with each other by the surfaces 43 and 44 on the side walls of the enclosure 20. When the legs 24 and 25 are partially inserted into the enclosure 20, the side walls of the enclosure 20 bear upon the knees 32 and 33, as well as the feet 26 and 27, to prevent the feet 26 and 27 from springing transversely outwardly when they reach longitudinal alignment with the side openings 34 and 35 in the shell 18 of the body member 15.

The feet 26 and 27 can only spring transversely outwardly away from contact with each other when the knees 32 and 33 reach longitudinal alignment with the openings 34 and 35. When the fork 16 is advanced into the enclosure 20 to this extent, the knees 32 and 33 are released and spring outwardly into engagement with the openings 34 and 35, as depicted in FIG. 4.

The catch 17 is a flat structure stamped from a sheet of stainless steel. The catch 17 includes a relatively broad exposed portion into which a pair of narrow transverse slots 45 and 46 are defined. The slots 45 and 46 are mutually parallel and coextensive with each other and are perpendicular to the alignment of the fork 16, the body member 15, and the catch 17.

The catch 17 also includes a pair of longitudinally projecting hooks 50 and 51 that have diverging, transversely sloping, inwardly facing surfaces 52 and 53. As illustrated in FIGS. 3 and 4, the tips of the hooks 50 and 51 are of a wedge-shaped configuration. Behind the sloping surfaces 52 and 53 the structures of the hooks 50 and 51 define transverse, bearing ledges 54 and 55.

When the catch 17 is inserted into the catch end opening 22 in the body member 15, the sloping surfaces 56 and 57 form a longitudinally extending, funnel-shaped entry into the enclosure 20 at the catch end opening 22. When the catch 17 is inserted into the catch end opening 22 the transverse walls 56 and 57 guide the tips of the hooks 50 and 51 into proper position to engage the feet 26 and 27 of the fork 16, as illustrated in FIG. 5.

One end of each of the short camera coupling strap segments 62 is threaded through the slots 45 and 46 in the catches 17 to lock the strap segments 62 to the catches 17 due to the force of friction therebetween. This frictional force of attachment is enhanced when tension is exerted between the neck strap 60 and the camera coupling strap segments 62.

The attachment and detachment of the forks 16, body members 15 and catches 17 is substantially the same as described in prior U.S. Pat. No. 4,559,679. However, the structure of each of the body members 15 of the improved strap fastener 10 of the present invention has small, but very important differences from the structure of the body member 15' of the strap fastener of prior U.S. Pat. No. 4,559,679.

Figure 8:
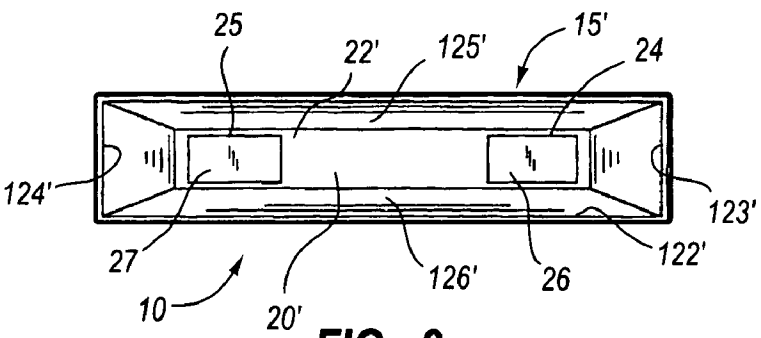
FIG. 8 (Prior Art)
FIG. 8 is an end view of a prior art strap fastening body member with the fork engaged therein.

FIG. 8 is an end view that illustrates the body member 15' of the strap fastener 10' of the '679 patent, as shown from the catch end opening 22' thereof. As illustrated in FIG. 8, the catch end opening 22' of the prior art '679 strap fastener has an open mouth 122' which is substantially rectangular in configuration. Although the side edge walls 123' and 124', as well as the top and bottom walls 125' and 126' form a funnel-shaped entry that has a reduced area within the enclosure 20' with distance from the mouth 122', the rectilinear ends of the mouth 122' unfortunately allow a slight twisting action to occur between the hooks 50 and 51 of the catch 17 and the feet 26 and 28 of the fork 16 if torsional forces are exerted in opposite directions on the fork 16 and catch 17.

While torsional forces are not likely to develop in a helmet strap, it is apparent from FIG. 1 that torsional forces can easily be applied by twisting of the camera neck strap 60 relative to the camera coupling strap segments 62. Such torsional forces can occur if the camera 64 is suspended and is twisted at the end of the strap system illustrated in FIG. 1.

The body member 15' shown in FIG. 8 will hold the fork 16 and catch 17 in substantially coplanar relationship within the enclosure 20 in the absence of torsional forces exerted between the fork 16 and the catch 17. However, if such torsional forces do occur, the catch 17 is not sufficiently constrained to absolutely prevent disengagement of the hooks 50 and 51 from the feet 26 and 27 of the fork 16. Should this occur the catch 17 will abruptly and unexpectedly disengage from the fork 16, thus allowing the camera 64 to fall and become damaged. Since cameras are delicate, expensive items, the unexpected disengagement of catch 17 from the fork 16 can result in a very expensive repair, or even the total destruction of the camera 64.

Figure 9:
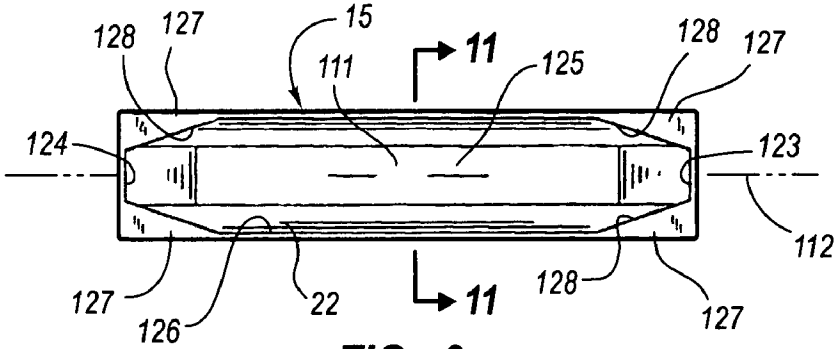
FIG. 9 is an end view of the body member of the invention taken along the lines 9-9 of FIG. 4, and shown in isolation from the fork.

The present invention greatly reduces the likelihood of misalignment between the fork 16 and the catch 17 within the enclosure 20 of the body member 15 by reconfiguring the catch entry slit at the catch entry end 22 of the body member 15. The catch end opening 22 is configured to create a slit that forms a mouth 125 which includes a central region 126 having a uniform cross section throughout and transverse end extremity regions 123 and 124 that narrow in thickness proceeding in distance transversely outwardly away from the fork legs 24 and 25, as illustrated in FIG. 9. The transverse end extremity regions 123 and 124 of the mouth 126 have a generally triangular shape and form blunted points that narrow from the central region 126 of the mouth 125. That is, the slit forming the mouth 125 at the catch end 22 of the body member 15 narrows at its ends so that the mouth 125 has opposing corners at the transverse extremity regions 123 and 124 that are pointed transverse outwardly, away from the fork legs 24 and 25. As illustrated in FIG. 9, the opposing corners of the mouth 125 at the end regions 123 and 124 have a truncated triangular shape.

Figure 10:
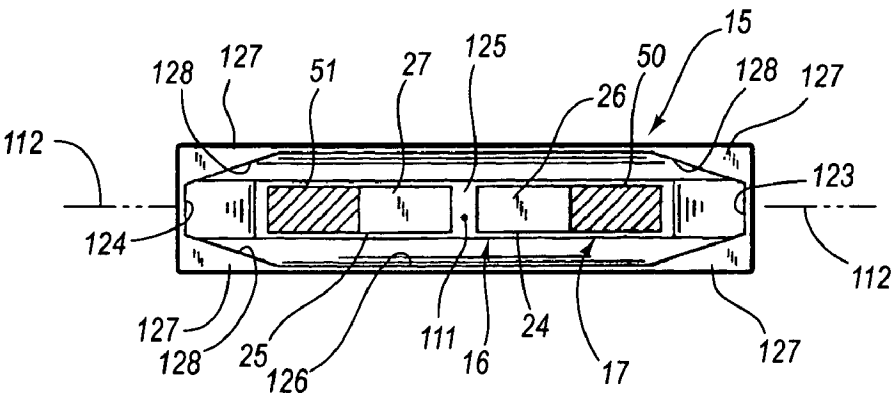
FIG. 10 is a sectional end view taken along the lines 10-10 of FIG. 7.

The body member 15 has a thickened wall structure at the opposing corners of the mouth 125. This thickened wall structure is created by four interior triangular-shaped corner restraints 127 molded into each of the four corners of the body member 15 at the catch end opening 22 of the body member 15, as illustrated in FIGS. 9 and 10. The corner restraints 127 are created within the narrow enclosure 20 within the body member 15 at the outboard extremities of the catch end opening 21. The mouth 126 of the catch end opening 21 is thereby defined with opposing, pointed outboard corners at its end extremity regions 123 and 124.

As shown in FIGS. 9 and 10, the catch end opening 22 forms a longitudinally inwardly directed funnel entry within the structure of the body member 15 with a mouth 125 of the catch end opening 22 that narrows at its opposing corners 123 and 124 outboard from fork legs 24 and 25. Between the opposing corners 123 and 124 the central region 126 of the mouth 125 is of uniform thickness.

Figure 11:
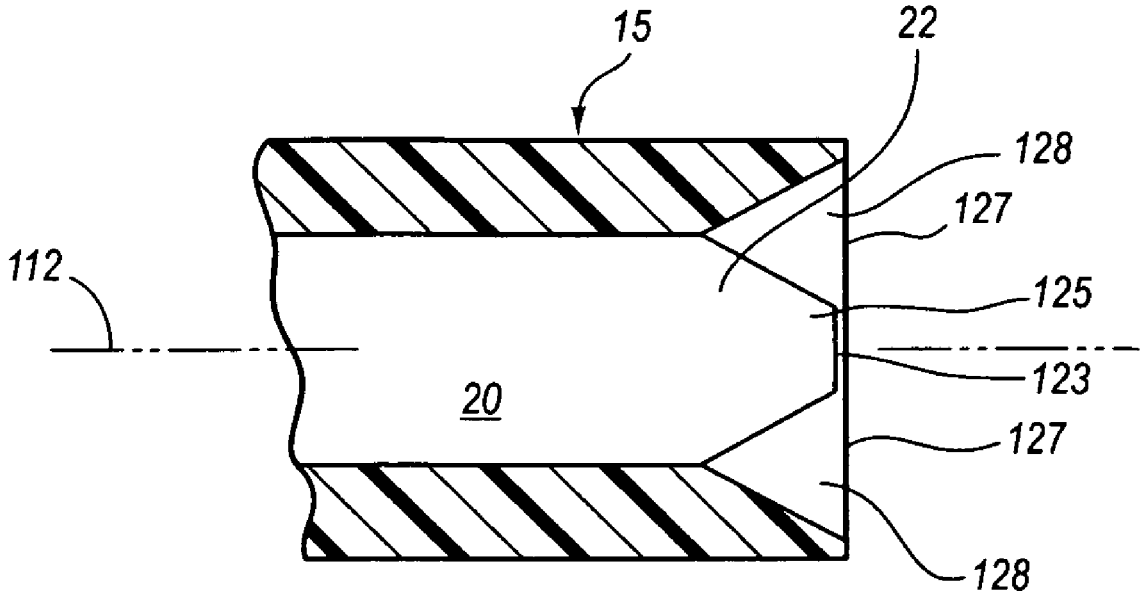
FIG. 11 is an enlarged sectional detail taken along the lines 11-11 of FIG. 9.

Due to the triangular wedge-shaped corner restraints 127 created by the additional material molded into the structure of the body member 15, the interior walls of the body member 15 bounding the enclosure 20 are internally thicker at the end extremity regions 123 and 124 of the mouth 125 than at the central region 126 thereof. The corner restraints 127 define longitudinally extending, triangular-shaped faces 128 that all reside at equal, acute angles relative to the plane of transverse symmetry 112 of the body member 15, as illustrated in FIGS. 9-11. Preferably each face 128 resides at an angle of about eighteen degrees relative to the transverse plane of symmetry 112.

Due to the construction of the corner restraints 127, the end extremity regions 123 and 124 of the mouth 125 are pinched relative to the central region 126 of the mouth 125. The opposing corners or transverse outboard end extremity regions 123 and 124 of the mouth 125 narrow in area outboard from the fork legs 24 and 25, as illustrated in FIG. 9. The mouth corners 123 and 124 narrow with increasing distance from the fork legs 24 and 25. The body member 15 has a thickened wall structure at the opposing corners 123 and 124 of the mouth 125, created by the triangular wedge-shaped corner restraints 127, that give the corners 123 and 124 of the mouth 125 a truncated triangular shape. The mouth 125 of the catch end opening 22 is thereby narrower at its outboard corner extremities 123 and 124 than it is at the fork leg feet 26 and 27.

By reconfiguring the catch end opening 22 of the body member 15 so that the mouth 125 at the catch end opening 22 is narrower at its outboard extremities than in its central region, the outboard structure of the catch 17 is constrained by the wedge-shaped corner restraints 127 of the body member 15 so that the catch 17 cannot twist as easily out of coplanar alignment with the fork 16 as is otherwise possible with the body member 15' having the prior art mouth configuration 125' as shown in FIG. 8. As a consequence, there is far less danger for unintentional detachment of the catch 17 from the fork 16 in each of the strap fasteners 10 than is possible with conventional strap fasteners.

Undoubtedly, numerous variations and modifications of the invention will become readily apparent to those familiar with strap fasteners. For example, the thickened regions of the body member 15 forming the corner restraints 127 at the four corners of the interior of the body member 15 could be formed as rectangular-shaped knees, rather than triangular wedges. Accordingly, the scope of the invention should not be construed as limited to the specific embodiment depicted and described, but rather is defined in the claims appended hereto.

I claim:

1. In a strap fastener having a body member with transverse side openings therein and defining an enclosure having opposing end openings both formed as narrow slits and including a fork end opening and a longitudinally opposite catch end opening, a fork having a loop for securement to one strap member and a pair of resilient legs for insertion into said fork end opening, each leg defining a transversely turned out foot having a bearing ledge at the leg extremity and an outwardly projecting knee between said loop and said bearing ledge, wherein said knees of said legs project into said transverse side openings in said body member and longitudinally immobilize said fork relative to said body member unless said feet are brought together by resilient deflection of said legs transversely toward each other, and a catch for securement to another strap member, said catch including a pair of hooks to transversely deflect and engage said feet of said fork when said catch is moved into said catch end opening with said fork longitudinally immobilized in said body member, and wherein said body member includes a pair of opposing, outwardly biased, inwardly deflectable arms for forcing said knees of said fork legs toward each other to disengage said feet of said fork legs from said hooks, and said body member defines a longitudinally extending funnel-shaped entry into said enclosure at said catch end opening, the improvement wherein said catch end opening has a mouth with transverse, opposing extremities that narrow in area proceeding in outboard directions outwardly away from said fork legs.

2. A strap fastener according to claim 1 wherein said narrow slit forming said catch end opening has opposing extremities that narrow uniformly in area with increased distance outboard from said fork legs.

3. A strap fastener according to claim 1 wherein said body member has interior corner restraints in said enclosure at said catch end opening that delineate opposing corners of said mouth that narrow said mouth with distance from said fork legs.

4. A strap fastener according to claim 1 wherein said mouth of said catch end opening is pointed at its corners outboard from said fork legs.

5. A strap fastener according to claim 1 wherein said structure of said body member is internally thicker at said transverse opposing extremities of said catch end opening, thereby narrowing said slit thereof at its outboard extremities remote from said fork legs.

6. A strap fastener according to claim 1 wherein said mouth of said catch end opening narrows uniformly toward its outboard extremities from said fork leg feet.

7. In a strap fastener having a body member with transverse side openings therein and defining an enclosure having opposing end openings including a fork end opening and a catch end opening, a fork having a central loop for securement to a load bearing member and a pair of resilient legs for insertion into said fork end opening, each leg defining a transversely turned out foot having a bearing ledge at the leg extremity, and an outwardly projecting knee between said loop and each of said bearing ledges, wherein said knees of said legs project into said transverse side openings in said body member and longitudinally immobilize said fork relative to said body member unless said feet are brought together by deflection of said legs transversely toward each other, and a catch for securement to another load bearing member, said catch including a pair of hooks to transversely deflect and engage said feet of said fork when said catch is moved into said catch end opening with said fork longitudinally immobilized in said body member and with said catch and said fork residing in coplanar relationship, and wherein said body member includes outwardly biased, inwardly deflectable arms for forcing said knees of said fork legs toward each other to disengage said feet of said fork legs from said hooks, and said body member has a catch entry slit at said catch end opening, the improvement wherein said catch entry slit forms a mouth with a central region having a uniform thickness throughout, and transverse end extremity regions that narrow in thickness proceeding in distance transversely outwardly away from said fork legs.

8. A strap fastener according to claim 7 wherein said transverse end extremity regions of said mouth are shaped as blunted points that narrow from said central region of said mouth.

9. A strap fastener according to claim 7 wherein said catch entry slit narrows at its ends so that said mouth has opposing corners that are pointed transverse outwardly.

10. A strap fastener according to claim 7 wherein said body member has walls bounding said enclosure that are internally thicker at said end extremity regions of said mouth than at said central region thereof.

11. A strap fastener according to claim 7 wherein said end extremity regions of said mouth are pinched relative to said central region of said mouth.

12. In a strap fastener having a body member with transverse side openings and defining a narrow enclosure having opposing narrow, transverse end openings including a fork end opening and a catch end opening, a flat fork having a central loop for securement to a load bearing member and a pair of resilient legs for insertion into said fork end opening, each leg defining a transversely turned out foot having a bearing ledge at its leg extremity and an outwardly projecting knee between said loop and said bearing ledge, wherein said knees of said legs project into said transverse side openings in said body member and longitudinally immobilize said fork relative to said body member unless said feet are brought together by resilient deflection of said legs transversely toward each other, and a flat catch for securement to another load bearing member, said catch including a pair of hooks to transversely deflect and engage said feet of said fork when said catch is moved into said catch end opening with said fork longitudinally immobilized in said body wherein said catch and said fork reside in mutually coplanar relationship, and wherein said body includes outwardly biased, inwardly deflectable arms for forcing said knees of said fork legs toward each other to disengage said feet of said fork legs from said hooks, and said catch end opening forms a longitudinally inwardly directed funnel entry within its structure, the improvement characterized in that said body member is formed with four interior corner restraints within said narrow enclosure at the outboard extremities of said catch end opening that define a mouth of said catch end opening that has opposing outboard corners that narrow with increasing distance from said fork legs.

13. A strap fastener according to claim 12 wherein said opposing corners of said mouth are pointed outwardly.

14. A strap fastener according to claim 13 wherein said opposing corners of said mouth have a truncated triangular shape.

15. A strap fastener according to claim 13 wherein said body member has a thickened interior wall structure that forms said interior corner restraints as integrally formed, wedge-shaped shims.

16. A strap fastener according to claim 12 wherein said mouth is formed as a narrow slit with said corners of said mouth shaped with pointed ends that have truncated tips.

17. A strap fastener according to claim 12 wherein said body member defines a central, longitudinal axis of alignment and said interior corner restraints have planar, longitudinal, triangular-shaped faces that are all parallel to said longitudinal axis of alignment.

18. A strap fastener according to claim 17 wherein said body member defines a transverse plane of symmetry containing said longitudinal axis of symmetry, and said longitudinal faces of said corner restraints all reside at equal, acute angles with said transverse plane of symmetry.

19. A strap fastener according to claim 18 wherein said longitudinal faces of said corner restraints all reside at an angle of about eighteen degrees relative to said transverse plane of symmetry.

* * * * *